US012768604B2

(12) United States Patent
Cavadini et al.

(10) Patent No.: US 12,768,604 B2
(45) Date of Patent: Oct. 20, 2026

(54) HEAT EXCHANGER AND HEAT PUMP HAVING AT LEAST ONE SUCH HEAT EXCHANGER

(71) Applicant: Siemens Energy Global GmbH & Co. KG, Munich (DE)

(72) Inventors: Philipp Cavadini, Berlin (DE); Marten Lorenz, Potsdam (DE); Dimitrios Thomaidis, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 110 days.

(21) Appl. No.: 18/713,656

(22) PCT Filed: Nov. 29, 2022

(86) PCT No.: PCT/EP2022/083599
§ 371 (c)(1),
(2) Date: May 26, 2024

(87) PCT Pub. No.: WO2023/099444
PCT Pub. Date: Jun. 8, 2023

(65) Prior Publication Data

US 2025/0012524 A1 Jan. 9, 2025

(30) Foreign Application Priority Data

Dec. 3, 2021 (DE) ..... 10 2021 213 766.0

(51) Int. Cl.
*F28F 13/12* (2006.01)
*F28F 1/40* (2006.01)
*F28F 3/02* (2006.01)

(52) U.S. Cl.
CPC ..... *F28F 13/12* (2013.01); *F28F 1/40* (2013.01); *F28F 3/027* (2013.01)

(58) Field of Classification Search
CPC .... F28F 13/12; F28F 1/40; F28F 3/027; F28F 3/048; F28F 7/02; F28F 9/0273; F28F 9/0075; F28D 1/053; F28D 2021/0068
See application file for complete search history.

(56) References Cited

U.S. PATENT DOCUMENTS 6,199,401 B1 * 3/2001 Haussmann ..... F28D 1/05391 165/DIG. 466
7,363,769 B2 4/2008 Kidwell
(Continued)

FOREIGN PATENT DOCUMENTS

CN 108050875 A 5/2018
CN 208187184 U 12/2018
(Continued)

OTHER PUBLICATIONS

English translation of CN 110168304A (Year: 2020).*
(Continued)

*Primary Examiner* — Tho V Duong
(74) *Attorney, Agent, or Firm* — Wolter Van Dyke Davis, PLLC

(57) ABSTRACT

A heat exchanger, in particular a tubular heat exchanger, a tube bundle heat exchanger, a finned tube heat exchanger and a plate heat exchanger, having at least one elongate flow duct through which a fluid is conducted during operation in a main flow direction corresponding to the longitudinal extent of the flow duct. The at least one flow duct has internal components and/or design features which give the fluid flowing in the main flow direction a swirl in a circumferential direction of the flow duct. A heat pump includes at least one such heat exchanger.

8 Claims, 15 Drawing Sheets

(56) References Cited

U.S. PATENT DOCUMENTS

| | | | | |
|---|---|---|---|---|
| 7,806,171 | B2 * | 10/2010 | Taras | F28F 9/0243 165/174 |
| 10,883,776 | B2 | 1/2021 | Feldkeller | |
| 11,561,052 | B2 | 1/2023 | Martini | |
| 2008/0190593 | A1 * | 8/2008 | Wang | F28F 9/22 29/890.03 |
| 2009/0107171 | A1 * | 4/2009 | Brodie | F25B 41/00 62/500 |
| 2012/0247600 | A1 | 10/2012 | McNulty | |
| 2020/0132378 | A1 | 4/2020 | Dong | |
| 2022/0155021 | A1 | 5/2022 | Kikuchi | |
| 2022/0325956 | A1 | 10/2022 | Jiang | |

FOREIGN PATENT DOCUMENTS

| | | | | | |
|---|---|---|---|---|---|
| CN | 110168304 | A | * | 8/2019 | F28F 9/0273 |
| DE | 202015103710 | U1 | | 8/2015 | |
| DE | 102017211529 | A1 | | 1/2019 | |
| DE | 102018109517 | A1 | | 10/2019 | |
| DE | 102019113205 | A1 | | 11/2020 | |
| DE | 102020202835 | A1 | | 9/2021 | |
| EP | 1965165 | B1 | | 10/2011 | |
| EP | 3431911 | A1 | | 1/2019 | |
| EP | 3537086 | A1 | | 9/2019 | |
| JP | S5257148 | Y1 | | 12/1977 | |
| JP | S5473552 | U | | 5/1979 | |
| JP | S59205585 | A | | 11/1984 | |
| JP | H06123579 | A | | 5/1994 | |
| JP | 2001255095 | A | | 9/2001 | |
| JP | 2006234267 | A | | 9/2006 | |
| JP | 2020085379 | A | | 6/2020 | |
| KR | 20040045739 | A | | 6/2004 | |
| WO | 2017052798 | A1 | | 3/2017 | |
| WO | WO-2020113988 | A1 | * | 6/2020 | F28F 9/0273 |
| WO | 2021025151 | A1 | | 2/2021 | |
| WO | 2021068760 | A1 | | 4/2021 | |
| WO | WO-2023284388 | A1 | * | 1/2023 | F28D 7/10 |

OTHER PUBLICATIONS

PCT International Search Report and Written Opinion of International Searching Authority mailed Apr. 6, 2023 corresponding to PCT International Application No. PCT/EP2022/083599 filed Nov. 29, 2022.

Menni Younes et al: "Enhancement of convective heat transfer in smooth air channels with wall-mounted obstacles in the flow path", Journal of Thermal Analysis and Calorimetry, Apr. 17, 2018, pp. 1951-1976, Bd. 135, Nr. 4, Kluwer, Dordrecht, NL.

* cited by examiner

HEAT EXCHANGER AND HEAT PUMP HAVING AT LEAST ONE SUCH HEAT EXCHANGER

CROSS REFERENCE TO RELATED APPLICATIONS

This application is the US National Stage of International Application No. PCT/EP2022/083599 filed 29 Nov. 2022, and claims the benefit thereof, which is incorporated by reference herein in its entirety. The International Application claims the benefit of German Application No. DE 10 2021 213 766.0 filed 3 Dec. 2021.

FIELD OF INVENTION

The invention relates to a heat exchanger, wherein the heat exchanger has at least one elongate flow duct, through which a fluid is passed during operation in a main flow direction corresponding to the longitudinal extent of the flow duct. The invention furthermore relates to a heat pump having such a heat exchanger.

BACKGROUND OF INVENTION

Heat exchangers of this kind are used in heat pump systems, for example, and are known in various embodiments in the prior art. In this context, different heat exchanger designs are used, e.g. tubular heat exchangers, tube bundle heat exchangers, finned tube heat exchangers and plate heat exchangers. One disadvantage of these heat exchangers is that they occupy a large installation space. Moreover, only a low COP value (Coefficient of Performance) is currently being achieved by this means. The COP value describes the efficiency of the heat pump system. It indicates the ratio of the heat output and the working energy required to achieve it, which is fed to the heat pump system in the form of electric current.

SUMMARY OF INVENTION

Proceeding from this prior art, it is an object of the present invention to provide an improved heat exchanger and an improved heat pump of the type stated at the outset which occupy a relatively small installation space and/or have an improved efficiency.

To achieve this object, the present invention provides a heat exchanger of the type stated at the outset which is characterized in that the at least one flow duct has internal components and/or design features which give the fluid flowing in the main flow direction a swirl in a circumferential direction of the flow duct. Studies have shown that the swirling of the fluid which is caused by such a deliberately caused swirl brings about an improvement in the intensity of heat transfer, especially in the states of the fluid in which it is liquid, not boiling and gaseous. Moreover, it has been found that, by virtue of the applied swirl, pressure losses can be minimized, especially in the boiling state of the fluid. Accordingly, the efficiency of the heat exchanger according to the invention can be optimized relative to conventional heat exchangers, in which the fluid flows through the flow duct only in the main flow direction, while the installation space remains the same. Alternatively, the installation space can be reduced while maintaining the same or an improved efficiency.

According to a first embodiment of the present invention, the at least one flow duct is designed as a tubular conduit of, in particular, circular cross section, wherein fixed, rigid swirl bodies, which each have a central center line extending in the main flow direction and guide vanes extending radially outward from this center line, which guide vanes impart the desired swirl to the fluid flowing against the respective swirl body, are inserted as internal components into the flow duct. It has been found that the intensity of heat transfer of a tubular conduit with such swirl bodies can be approximately doubled relative to a flow duct without swirl bodies.

According to another embodiment of the present invention, the at least one elongate flow duct is designed as a tubular conduit and is divided, at least in some region or regions, into at least two subducts extending parallel to one another in the main flow direction, between which there extends a partition wall, wherein the first subduct is provided downstream, and the second subduct is provided upstream, with a baffle plate extending transversely to the main flow direction, and wherein the partition wall is provided with fluid passage openings, through which the fluid introduced into the first subduct is passed into the second subduct. By means of this forced deflection of the fluid from the first subduct into the second subduct, brought about primarily by the baffle plate of the first subduct and the fluid passage openings, a swirl in the circumferential direction of the flow duct is deliberately imparted to the fluid. By means of such a construction of the at least one flow duct, the intensity of heat transfer of the heat pump system in comparison with conventional heat exchangers, in which the fluid is passed through a simple tubular conduit of circular cross section, can be increased by up to five times, and, in particular, this makes possible a significant reduction in the installation space.

The at least one elongate flow duct is preferably divided, at least in some region or regions, into three subducts extending parallel to one another in the main flow direction, between which there extends a respective partition wall, wherein the first, central, subduct is provided downstream, and the second subduct and the third subduct are each provided upstream, with a baffle plate extending transversely to the main flow direction, and wherein the partition walls are provided with fluid passage openings, through which the fluid introduced into the first subduct is passed into the second subduct and into the third subduct while being subjected to a swirl. By means of such a construction, it was possible to obtain the maximum increase in the intensity of heat transfer in comparison with conventional heat exchangers, in which the fluid is passed through a simple tubular conduit of circular cross section.

The first subduct preferably has a rectangular or, preferably, square cross section, and the second and third subducts each have a semicircular cross section. This construction has proven to be particularly simple, cheap and efficient.

The baffle plate of the first subduct is preferably provided with at least one through hole or preferably with at least one through slot. By virtue of such through holes and/or through slots, it is possible, in particular, to minimize frictional losses.

The fluid passage openings are preferably arranged spaced apart from one another in the main flow direction, wherein the distance between adjacent fluid passage openings preferably increases progressively downstream. By this means too, it is possible to reduce flow losses.

According to another embodiment of the present invention, a multiplicity of flow ducts is provided, wherein each flow duct is formed by a plurality of rectilinear flow duct sections which extend in the main flow direction, are connected to one another via fluid passage openings and are arranged in a mutually overlapping manner in the main flow direction and in a manner offset with respect to one another in directions transverse to the main flow direction, wherein each flow duct through which a hot fluid is passed is in contact, preferably over its entire length, with an adjacent flow duct, through which a cold fluid is passed. This arrangement of the individual flow duct sections, connected to one another via the fluid passage openings, in a mutually overlapping manner in the main flow direction and in a manner offset with respect to one another in directions transverse to the main flow direction, has the effect that the fluid passed through the flow duct is subjected to a swirl in the circumferential direction of the flow duct as it passes from one flow duct section to the next flow duct section. In the context of tests in respect of the increase in the intensity of heat transfer, the best results with such a construction were achieved with a factor of up to 7 relative to conventional heat exchangers, in which the fluid is passed through a tubular conduit of round cross section.

The flow duct sections are preferably formed by cuboidal hollow rods, in particular with square end faces, which are each provided at their free ends with a fluid passage opening. In this way, a simple modular construction is achieved. The hollow rods can be connected to one another materially, for example. However, the hollow rods can also be produced jointly in an additive process, with the result that individual hollow rods are present only virtually and not actually.

It is advantageous if the fluid passage openings are of slot-shaped design, wherein the slot width preferably corresponds to 0.1 to 0.3 times the length of an end face of the hollow rod, in particular 0.25 times. In this way, frictional losses can be minimized.

According to another embodiment of the present invention, the heat exchanger is in the form of a finned plate heat exchanger, which has a multiplicity of flow ducts, each of which is delimited by two parallel plates and obliquely positioned fins and has a trapezoidal cross section, wherein at least one end wall of each flow duct is provided with fluid passage openings, through which the fluid introduced into a flow duct is directed into an adjacent flow duct while being subjected to a swirl in the circumferential direction of the flow duct.

On the side from which the fluid is introduced into a flow duct (8), the fluid passage openings (15) are preferably each provided with a shield (27) that is of open design on the inflow side. The shields can be produced, for example, by means of slots and by forming the sheet forming the fin, whereby a very simple construction is achieved.

The present invention furthermore provides a heat pump having at least one heat exchanger according to the invention.

BRIEF DESCRIPTION OF THE DRAWINGS

Further advantages and features of the present invention will become clear from the following description with reference to the appended figures. In the figures.

DETAILED DESCRIPTION OF INVENTION

Figure 1:
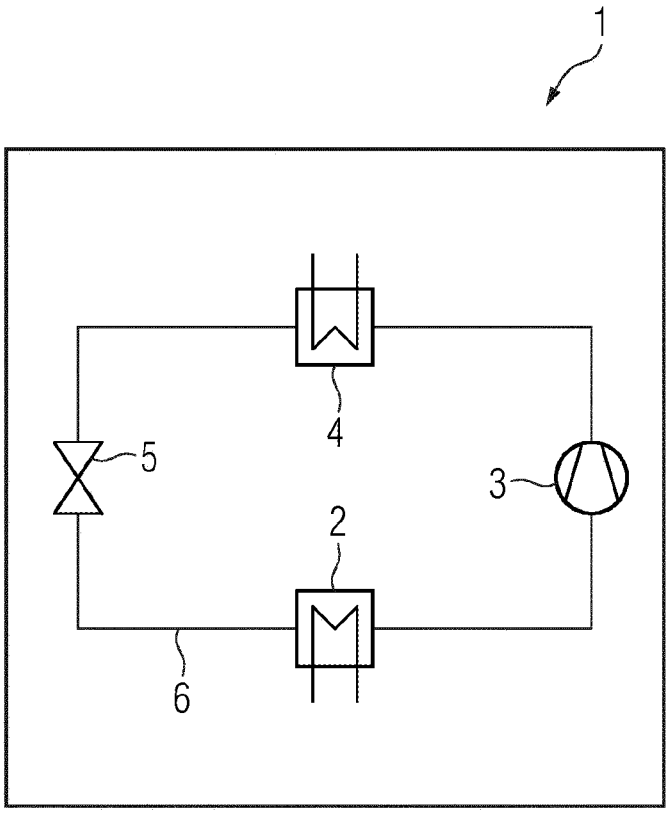
FIG. 1 shows a schematic view of a heat pump.

In the text which follows, the same reference numerals denote components or component regions which are the same or of the same type.

FIG. 1 shows schematically a heat pump 1, which has a first heat exchanger 2, a compressor 3, a second heat exchanger 4 and a restrictor 5, which are incorporated in series into a fluid circuit 6 through which a fluid in the form of a refrigerant is passed. In the first heat exchanger 2, energy is drawn from the heat source (e.g. air, water or earth), which is provided by nature, and transferred to the liquid refrigerant, evaporating the latter. In the vapor state, the refrigerant is then fed to the compressor 3, which then passes the compressed refrigerant to the second heat exchanger 4. In the second heat exchanger 4, the refrigerant is condensed, wherein the energy drawn from the refrigerant during this process is transferred to a fluid to be heated, e.g. heating water, which is correspondingly heated. Finally, the refrigerant is fed to the restrictor 5 and expanded, whereupon it is returned to the first heat exchanger 2.

In conventional heat exchangers 2, 4, irrespective of whether these are embodied as tubular heat exchangers, tube bundle heat exchangers, finned tube heat exchangers or plate heat exchangers, the fluids are each passed in a straight line in a main flow direction 7 through at least one elongate flow duct 8, wherein the main flow direction 7 corresponds to the longitudinal extent of the flow duct 8. The invention is based on the fundamental concept of providing the at least one flow duct 8 with internal components and/or design features which give the fluid flowing in the main flow direction 7 a swirl in a circumferential direction of the flow duct 8. The aim is in this way to increase the intensity of heat transfer and/or to reduce the required installation space for the heat exchanger 2, 4.

Figure 2:
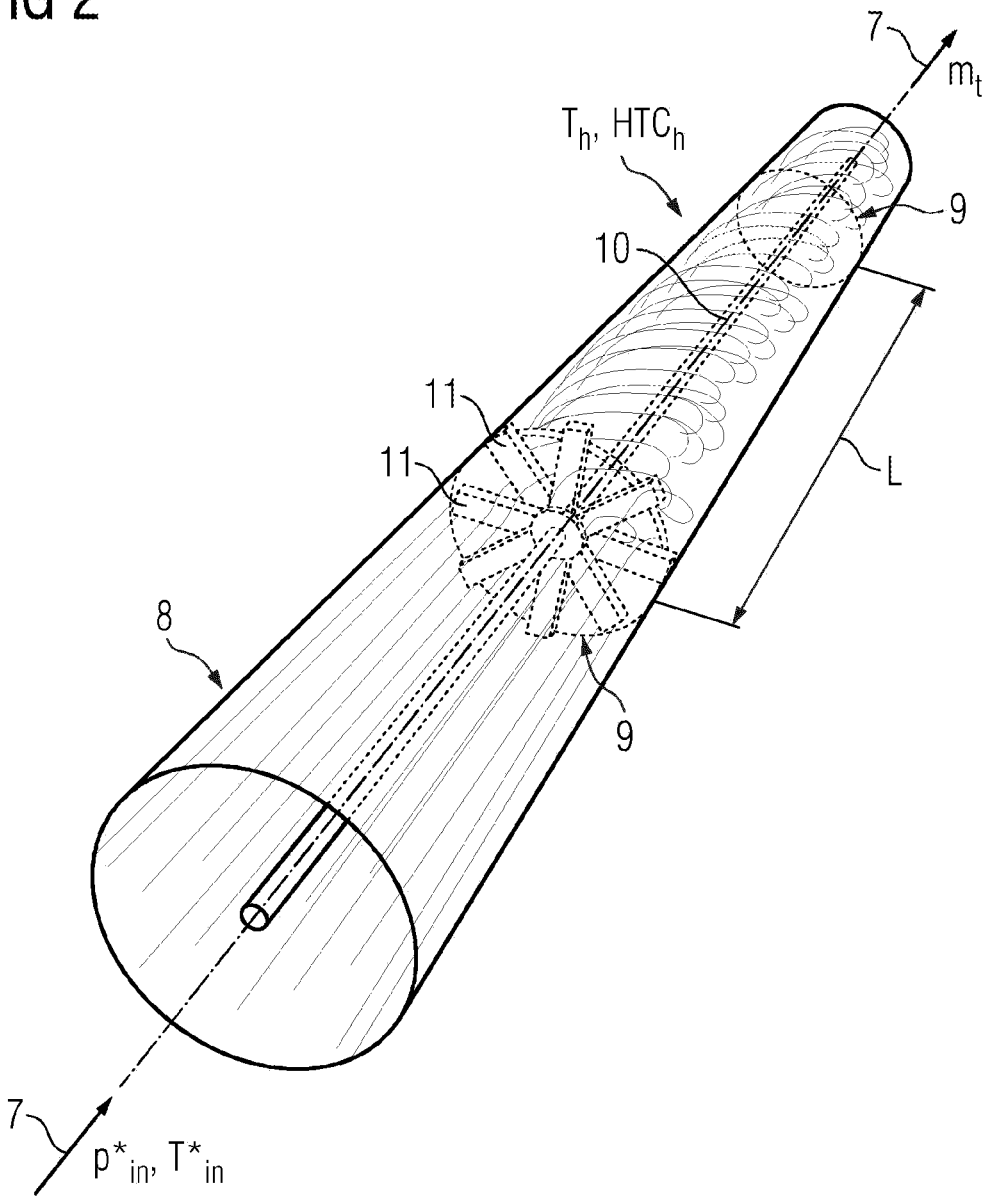
FIG. 2 shows a perspective view of a flow duct designed in accordance with a first approach according to the invention, which can be a flow duct of a heat exchanger of the heat pump shown in FIG. 1.
Figure 3:
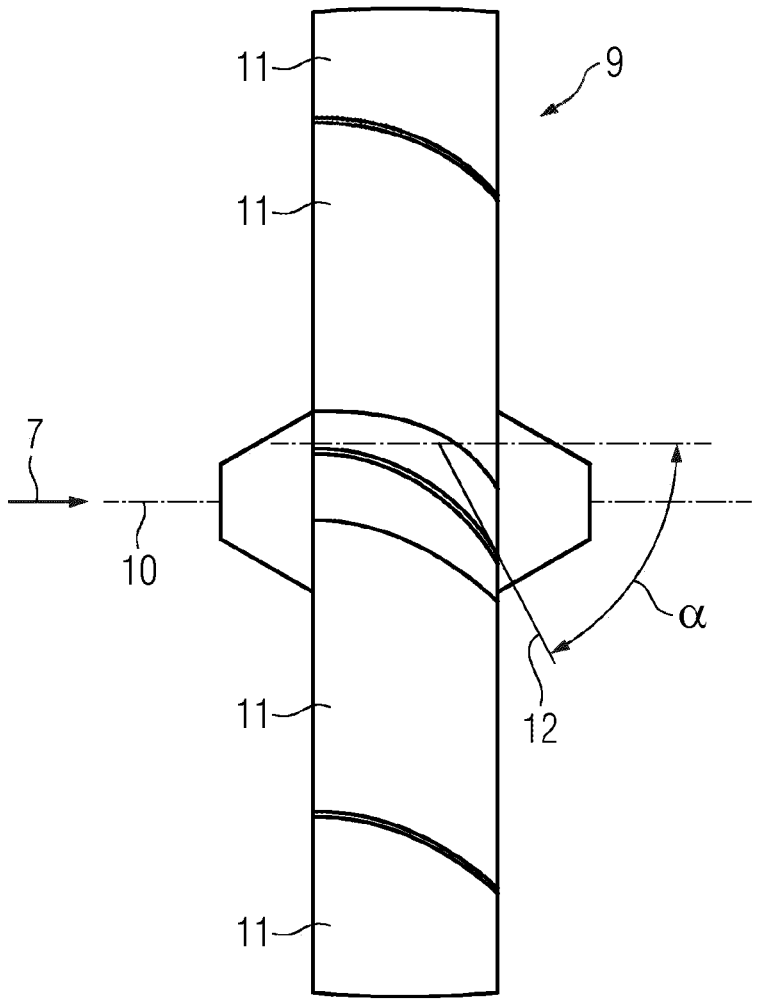
FIG. 3 shows an enlarged side view of a swirl body illustrated only schematically in FIG. 2.

FIGS. 2 and 3 show a first approach according to the invention, in which two swirl bodies 9 are inserted as internal components into a flow duct 8. The flow duct 8 is a tubular conduit which has a smooth internal surface and a circular cross section with the diameter D. The swirl bodies 9, which are inserted at a fixed location and in a rigid manner into the flow duct 8, each comprise a central center line 10 extending in the main flow direction 7 and guide vanes 11 extending radially outward from this center line 10, which impart the swirl in the circumferential direction to the fluid flowing against the swirl bodies 9 in the main flow direction 7. For this purpose, the guide vanes 11 in the present case are of arcuate design, wherein the angle $\alpha$ which the main flow direction 7 encloses with a tangent 12 placed against the downstream edge of a guide vane 11 is preferably 60°. This angle $\alpha$, like the number of guide vanes 11, which is eight in the present case, can be varied in principle.

In the context of a first test, a total fluid mass flow $m_t$ was passed through the flow duct 8 shown in FIG. 2 under the following conditions:

Fluid: Air (ideal gas)
Inlet pressure $p^*_{in}$=1 atm
Inlet temperature $T^*_{in}$=303.15 K
External temperature $T_h$=373.15 K
Heat transfer coefficient on the outside $HTC_h$
Reynolds number Re=variable
Nusselt number Nu based on the hydraulic diameter and friction factor f In a first measurement series, the swirl bodies 9 were positioned at a spacing L=6D.

In a second measurement series, the swirl bodies 9 were positioned at a spacing L=40D.

A reference measurement was carried out under analogous conditions, using the same flow duct 8 without the swirl bodies 9 positioned therein. This reference measurement is denoted by the index 0.

Figure 4:
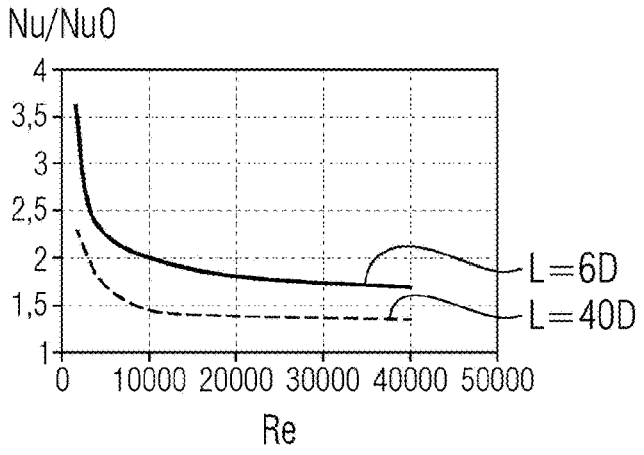
FIG. 4 shows a graph which indicates the improvement in the intensity of heat transfer of variants of the flow duct shown in FIG. 2 relative to a reference flow duct as a function of the Reynolds number.
Figure 5:
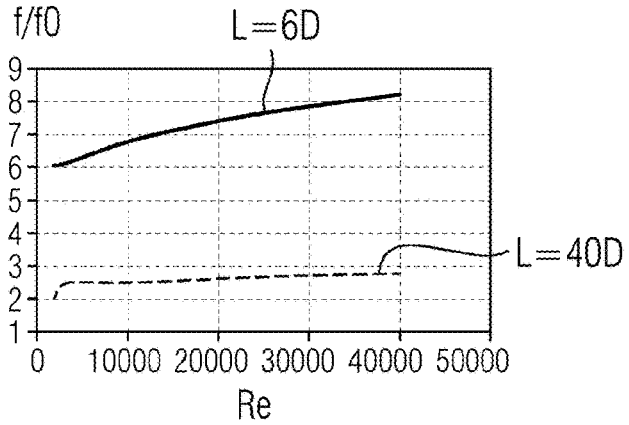
FIG. 5 shows a graph which indicates the increase in the hydraulic frictional loss in these variants relative to the reference flow duct as a function of the Reynolds number.
Figure 6:
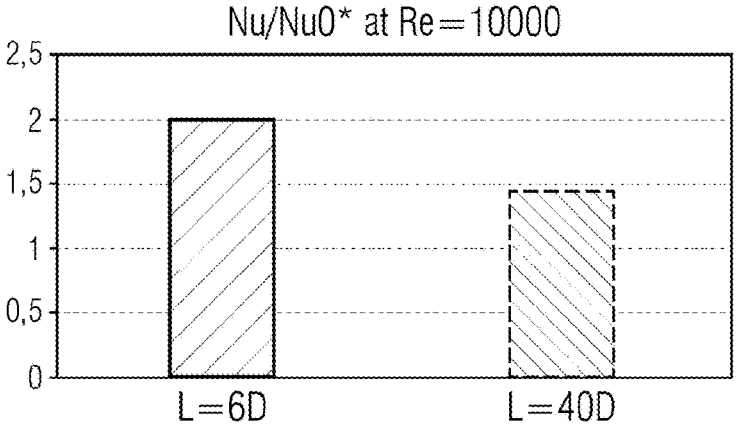
FIG. 6 shows a diagram which indicates the improvement in the intensity of heat transfer in these variants relative to the reference flow duct at a Reynolds number of 10,000.

FIGS. 4 to 6 show extracts of the results achieved in the context of the studies.

As shown in FIGS. 4 and 6, the arrangement of swirl bodies 9 in the flow duct 8 allows an increase in the intensity of heat transfer in the flow duct 8 relative to the reference measurement by 1.5 to 4 times, depending on the Reynolds number, with a simultaneous rise in the hydraulic losses by 2 to 8 times, see FIG. 5. A reduction in the spacing L between the two swirl bodies 9 leads to a rise in the intensity of heat transfer and to a rise in the hydraulic losses.

Figure 9:
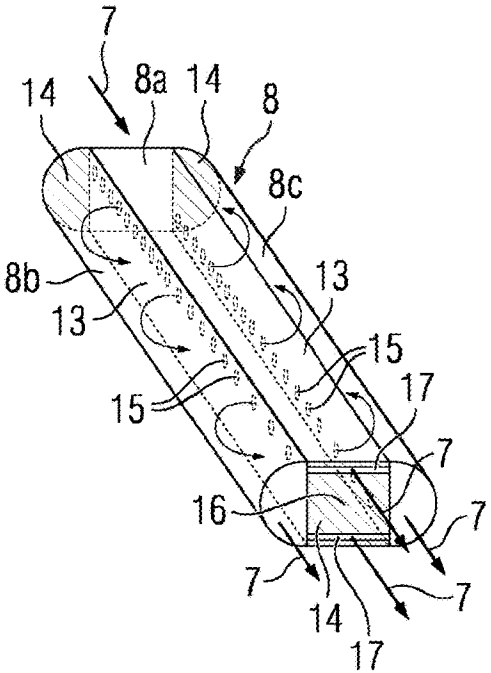
FIG. 9 shows a perspective view of a third variant of a flow duct designed in accordance with a second approach according to the invention, which can be a flow duct of a heat exchanger of the heat pump shown in FIG. 1.
Figure 8:
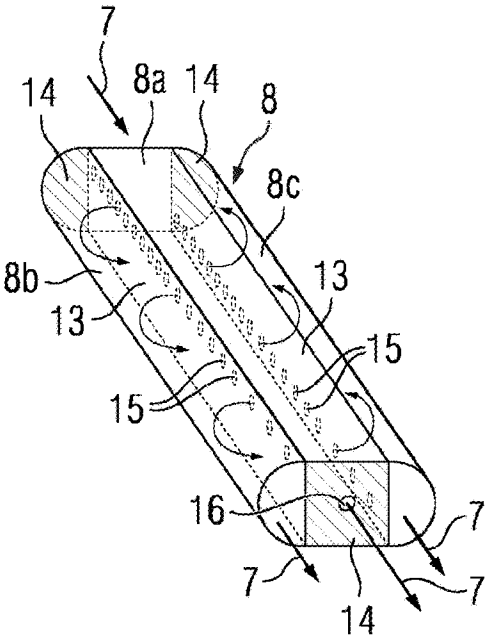
FIG. 8 shows a perspective view of a second variant of a flow duct designed in accordance with a second approach according to the invention, which can be a flow duct of a heat exchanger of the heat pump shown in FIG. 1.
Figure 7:
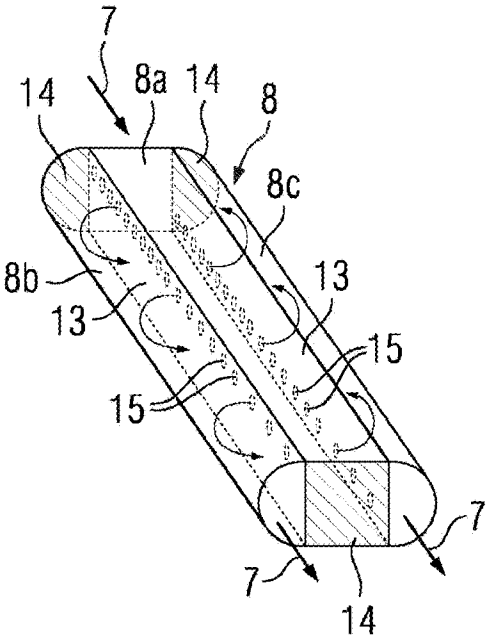
FIG. 7 shows a perspective view of a first variant of a flow duct designed in accordance with a second approach according to the invention, which can be a flow duct of a heat exchanger of the heat pump shown in FIG. 1.

FIGS. 7 to 9 show variants of a flow duct 8 designed in accordance with a second approach according to the invention, which is divided, at least in some region or regions, into a plurality of, in the present case three, subducts 8*a*, 8*b* and 8*c*, which extend parallel to one another in the main flow direction 7 and between which there is a respective partition wall 13. A first, central, subduct 8*a* of the flow duct 8 illustrated has a square cross section. The other two subducts 8*b* and 8*c*, which flank the central subduct 8*a*, each have a semicircular cross section.

The geometries of the variants of the flow ducts 8 which are illustrated in FIGS. 7 to 9 are fundamentally identical.

Figure 11:
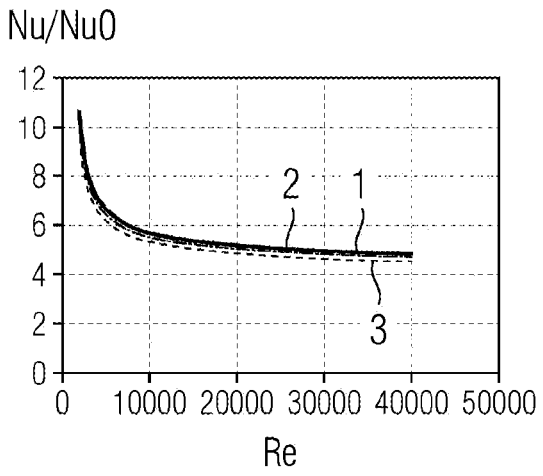
FIG. 11 shows a graph which indicates the improvement in the intensity of heat transfer of the variants illustrated in FIGS. 7 to 9 relative to the reference flow duct as a function of the Reynolds number.
Figure 12:
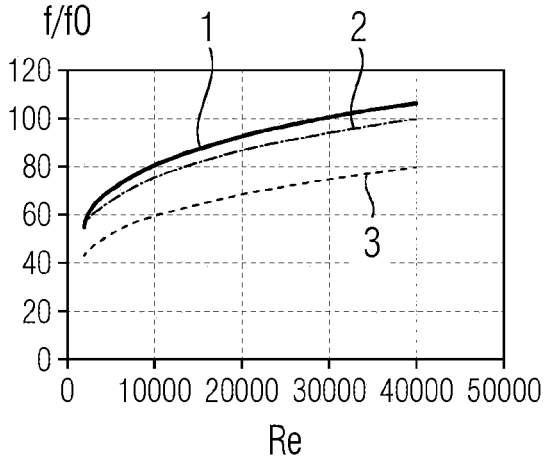
FIG. 12 shows a graph which indicates the increase in the hydraulic frictional loss in the variants illustrated in FIGS. 7 to 9 relative to the reference flow duct as a function of the Reynolds number.
Figure 13:
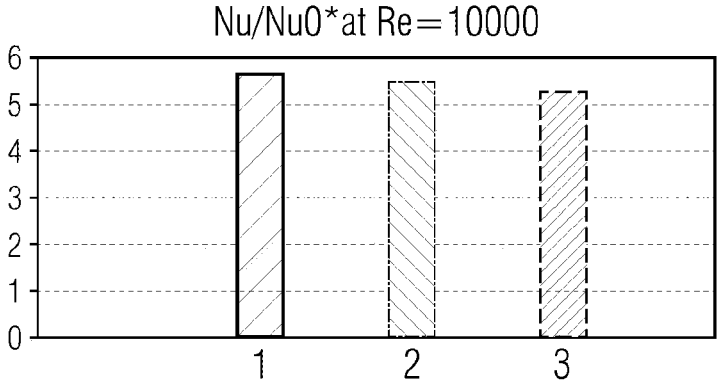
FIG. 13 shows a diagram which indicates the improvement in the intensity of heat transfer of the variants illustrated in FIGS. 7 to 9 relative to the reference flow duct at a Reynolds number of 10,000.
Figure 14:
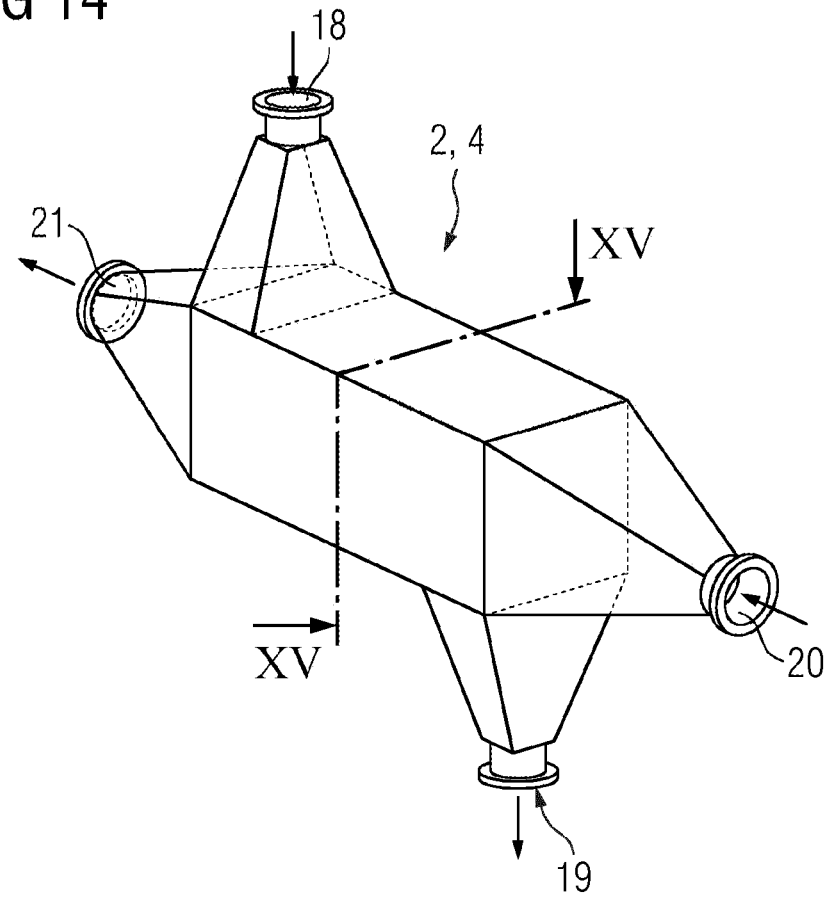
FIG. 14 shows a perspective view of a heat exchanger, which may be a heat exchanger of a heat pump shown in FIG. 1 in which the flow ducts are designed in accordance with a third approach according to the invention.
Figure 15:
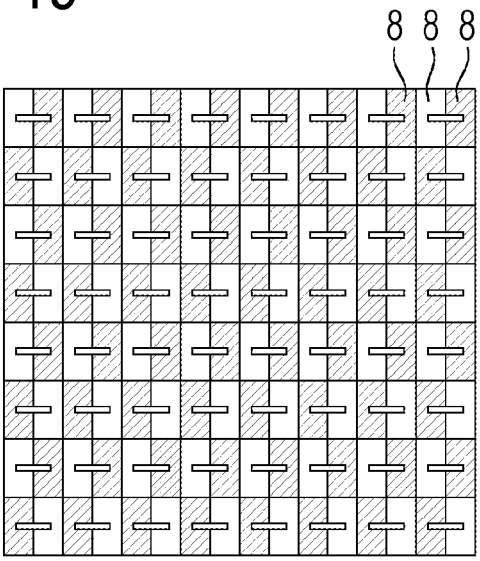
FIG. 15 shows a cross-sectional view along the line XV in FIG. 14.
Figure 16:
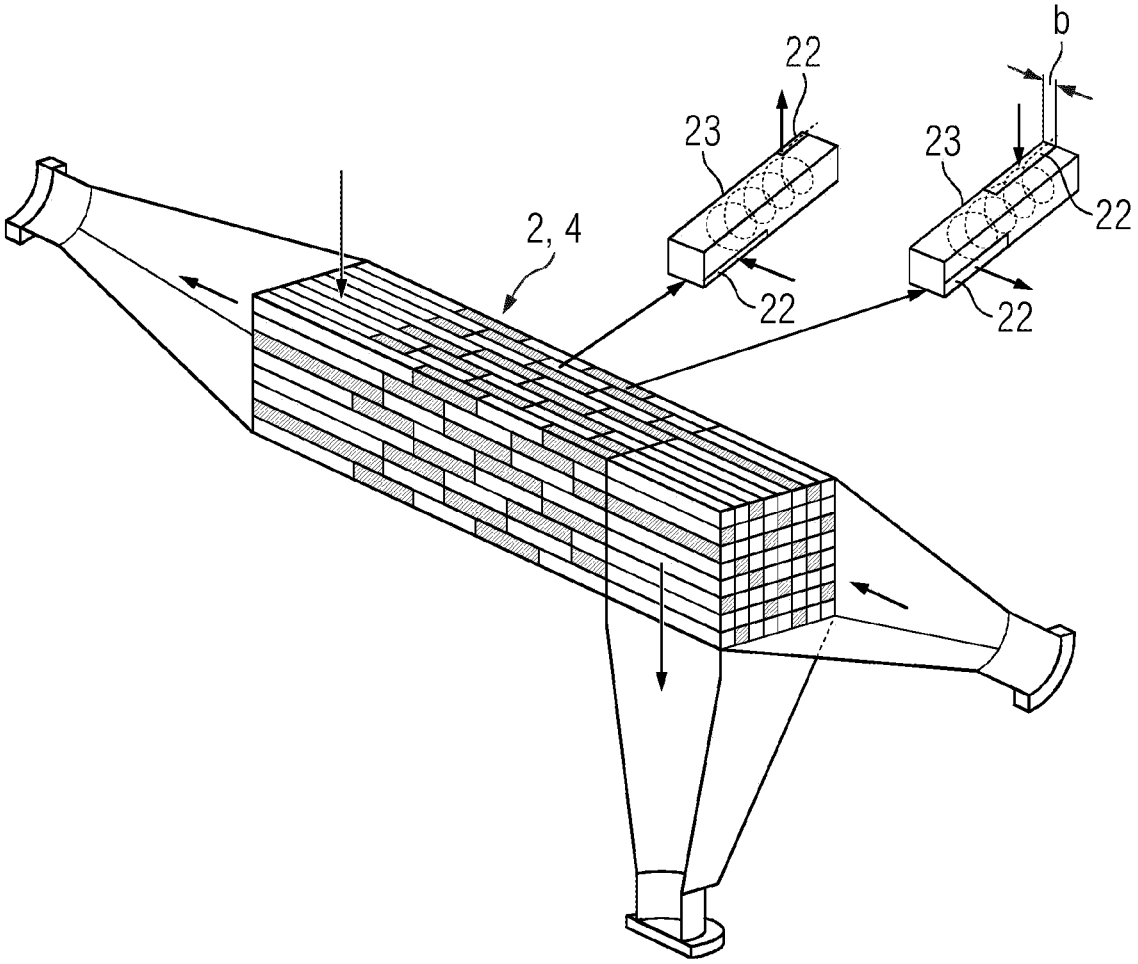
FIG. 16 shows another perspective view, shown as partially transparent, of the heat exchanger illustrated in FIG. 14.
Figure 17:
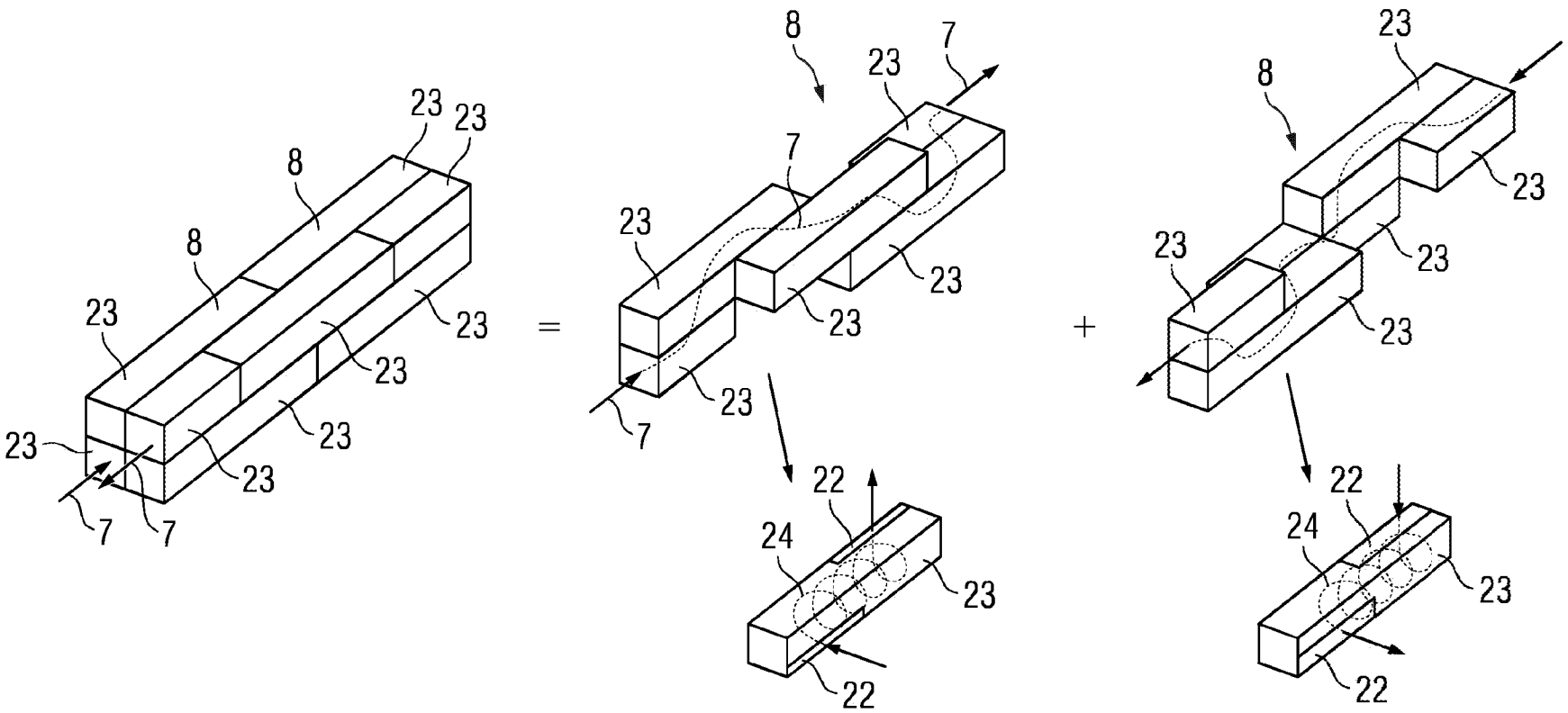
FIG. 17 shows a schematic view of two flow ducts of the heat exchanger illustrated in FIG. 14.

In the first variant of the flow duct 8, which is illustrated in FIG. 7 and which is represented by the number "1" in FIGS. 11 to 13, the first, central, subduct 8*a* is provided downstream, and the second subduct 8*b* and the third subduct 8*c* are each provided upstream, with a fully closed baffle plate 14 extending transversely to the main flow direction 7. Furthermore, the partition walls 13 are designed with fluid passage openings 15, through which the fluid introduced into the first subduct 8*a* is passed into the second subduct 8*b* and into the third subduct 8*c* while being subjected to a swirl. The spacing of the individual fluid passage openings 15 in the direction of the main flow direction 7 increases downstream in the embodiment illustrated. This geometry is denoted by the index 1 below.

The geometry of the second variant of the flow duct 8, which is shown in FIG. 8, which is represented by the number "2" in FIGS. 11 to 13, corresponds in substantial parts to that of the flow duct 8 shown in FIG. 7. Here, however, the baffle plate 14 that closes the first, central, subduct 8*a* is provided with a central, round through hole 16.

The geometry of the third variant of the flow duct 8, which is shown in FIG. 9 and is represented by the number "3" in FIGS. 11 to 13, differs from that of the flow duct 8 shown in FIG. 8 in that the baffle plate 14 that closes the first, central, subduct 8*a* is not provided with a central through hole 16 but, in the present case, with two horizontal through slots 17, which are positioned in the upper and in the lower region of the baffle plate 14.

In the context of a second test, a total fluid mass flow was passed through the flow ducts 8 shown in FIGS. 7 to 9 under the same conditions as those in the first test.

Figure 10:
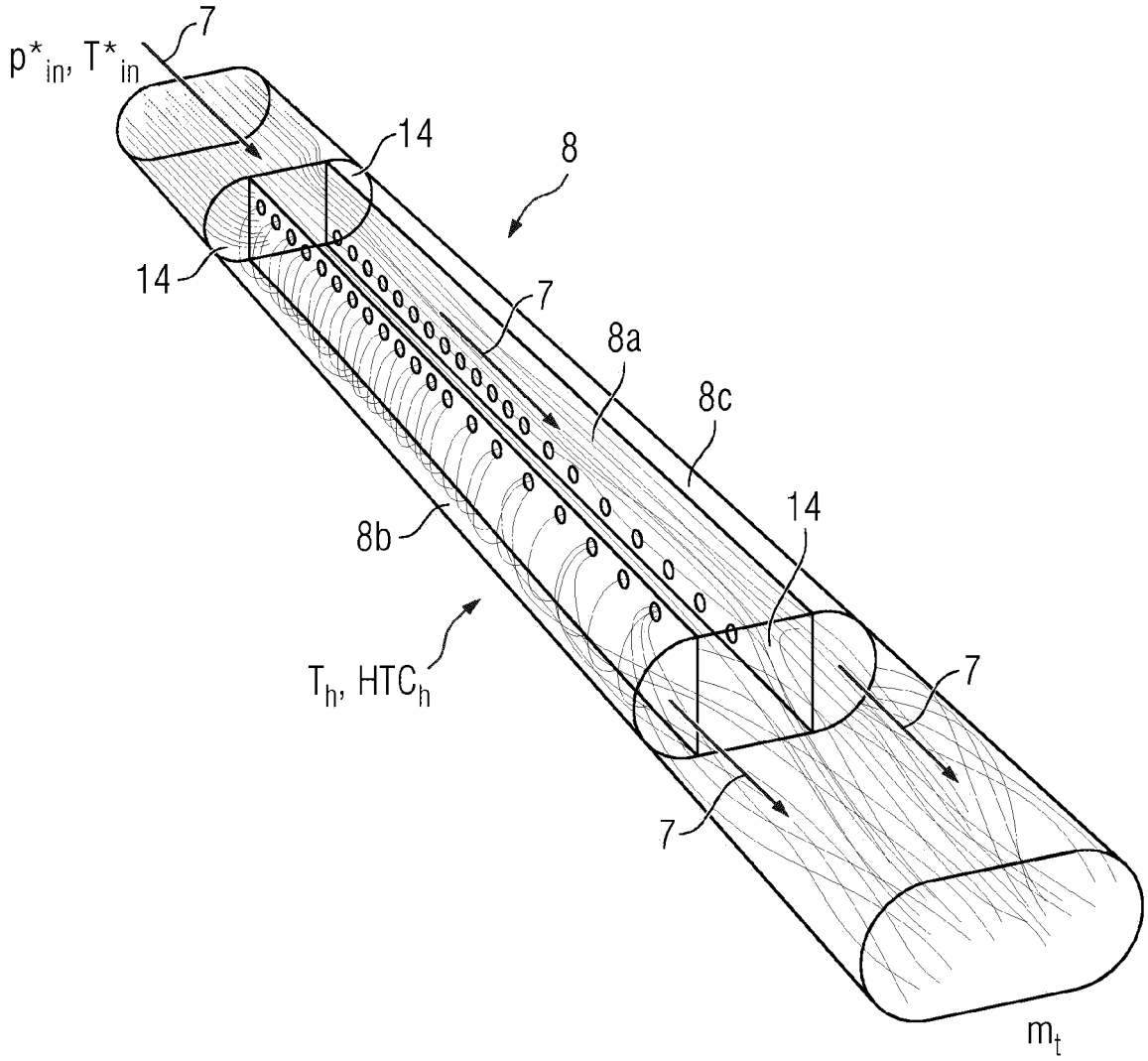
FIG. 10 shows a perspective view of the first variant shown in FIG. 7, which shows by way of example the deflection of a fluid passed through the flow duct.

FIG. 10 shows how the fluid passing through the fluid passage openings 15 is subjected to a swirl in the circumferential direction of the flow duct 8, as illustrated by arrows. The speeds of the fluid are at a maximum in the arcuate outer regions of the second and third subducts 8*b* and 8*c*.

FIGS. 11 to 13 show extracts of the results achieved in the context of the measurement series, and, here too, the simple tubular conduit was used as a reference, index 0.

As shown in FIGS. 11 to 13, the geometries of variants 1 to 3 allow an increase in the intensity of heat transfer in the flow duct 8 relative to the reference geometry 0 by 4 to 10 times, depending on the Reynolds number, with a simultaneous rise in the hydraulic losses by 40 to 100 times, see FIG. 12. The provision of a through hole 16 or of through slots 17 in the baffle plate 14 that closes the first subduct 8*a* leads to a significant reduction in the hydraulic losses with a simultaneous slight impairment of heat transfer, see FIGS. 11 and 12 together.

FIGS. 14 to 17 show a third approach according to the invention for increasing the intensity of heat transfer. The heat exchanger 2, 4 illustrated has a fluid inlet 18 and a fluid outlet 19 for a first fluid and a fluid inlet 20 and a fluid outlet 21 for a second fluid, wherein the fluids are passed in a countercurrent flow through the heat exchanger 2, 4 in the present case. For this purpose, a multiplicity of flow ducts 8 arranged in the form of a matrix when viewed in cross section is provided, see FIG. 15, wherein, as shown schematically in FIG. 17, each flow duct 8 is formed by a plurality of rectilinear flow duct sections which extend in the main flow direction, are connected to one another via fluid passage openings 22 and are arranged in a mutually overlapping manner in the main flow direction 7 and in a manner offset with respect to one another in directions transverse to the main flow direction 7. In the present case, the individual flow duct sections of a flow duct 8 are positioned in such a way that the flow duct 8 overall has a helical shape in the direction of its longitudinal extent. In this case, each flow duct 8 through which a hot fluid is passed is in contact, preferably over its entire length, with an adjacent flow duct 8 through which a cold fluid is passed, as shown on the left in FIG. 17. Two flow ducts 8 are thus each "intertwined" in the manner of a helix. The flow duct sections are each formed by cuboidal hollow rods 23, in the present case with square end faces, which are each provided at their free ends with a fluid passage opening 15. In the present case, the fluid passage openings 15 are of slot-shaped design and extend in the main flow direction 7, wherein the slot width b preferably corresponds to 0.1 to 0.3 times the length d of an end face of a hollow rod 23, in particular 0.25 times. This arrangement of the individual flow duct sections in a mutually overlapping manner in the main flow direction 7 and in a manner offset with respect to one another in directions transverse to the main flow direction 7 has the effect that the fluid flowing through the flow duct 8 is subjected to a swirl in the circumferential direction of the flow duct 8, as indicated by the dashed lines 24 in FIG. 17. The flow ducts 8 shown can be composed of individual hollow rods connected to one another, e.g. welded or brazed to one another. Alternatively, however, the matrix-like arrangement can also be produced in an additive process, with the hollow rods thus being merely virtual hollow rods.

In the context of a third test, a total fluid mass flow was passed through the flow ducts shown in FIGS. 14 to 17 under the same conditions as those in the first test. Here too, the simple tubular conduit was used as a reference, index 0.

Figure 18:
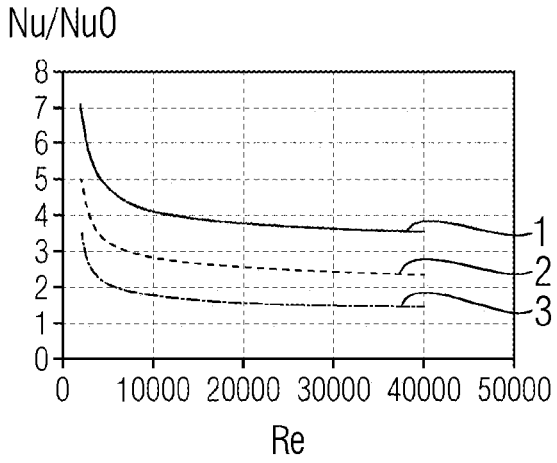
FIG. 18 shows a graph which indicates the improvement in the intensity of heat transfer of three variants of the flow ducts illustrated in FIG. 17 relative to the reference flow duct as a function of the Reynolds number.
Figure 19:
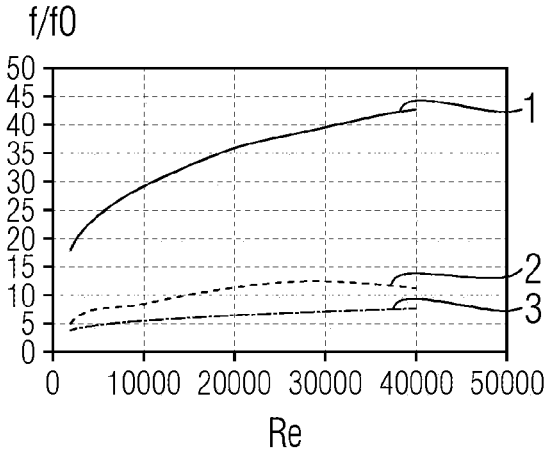
FIG. 19 shows a graph which indicates the increase in the hydraulic frictional loss in three variants of the flow ducts illustrated in FIG. 17 relative to the reference flow duct as a function of the Reynolds number.
Figure 20:
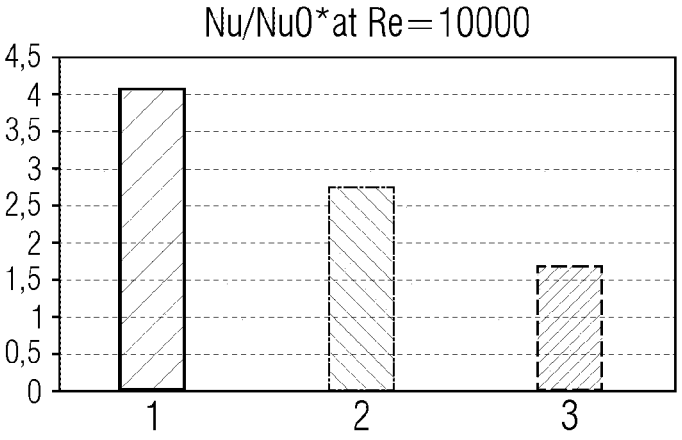
FIG. 20 shows a diagram which indicates the improvement in the intensity of heat transfer of three variants of the flow ducts illustrated in FIG. 17 relative to the reference flow duct at a Reynolds number of 10,000.

In a first variant, which is represented by the number "1" in FIGS. 18 to 20, the slot width b of the fluid passage openings of the hollow rods was 0.25 times the length d of an end face of the hollow rods, in a second variant (number "2") it was 0.5 times and, in a third variant (number "3"), it was 1 times.

FIGS. 18 to 20 show extracts of the results achieved in the context of the studies.

As shown in FIGS. 18 to 20, the geometries of variants 1 to 3 allow an increase in the intensity of heat transfer in the flow duct 8 relative to the reference geometry 0 by 4 to 7 times, depending on the Reynolds number, with a simultaneous rise in the hydraulic losses by 20 to 45 times, see FIG. 19. In this case, the geometry with the smallest slot width b has the greatest increase both in intensity and friction. It is assumed that, in particular, the increased friction can be significantly further optimized by optimizing the geometry of the flow ducts 8.

Figure 21:
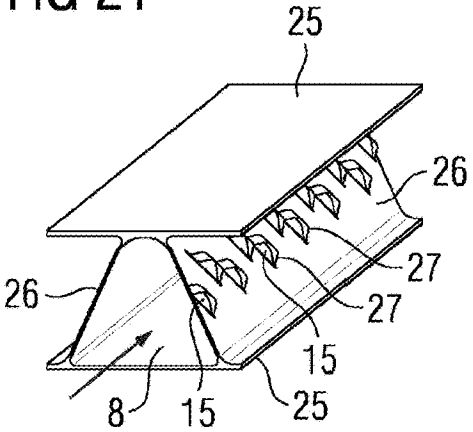
FIG. 21 shows a perspective view of a first variant of a flow duct designed in accordance with a fourth approach according to the invention, which can be a flow duct of a heat exchanger of the heat pump shown in FIG. 1.
Figure 22:
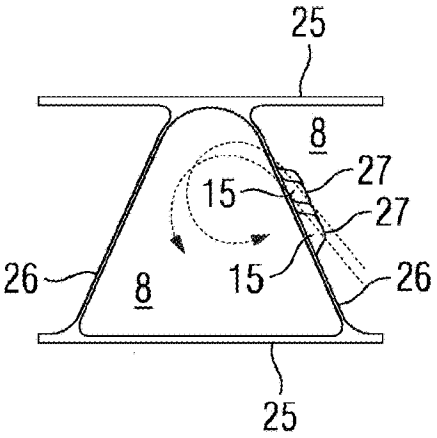
FIG. 22 shows a front view of the flow duct illustrated in FIG. 21, which shows the deflection of a fluid passed through the flow duct.
Figure 23:
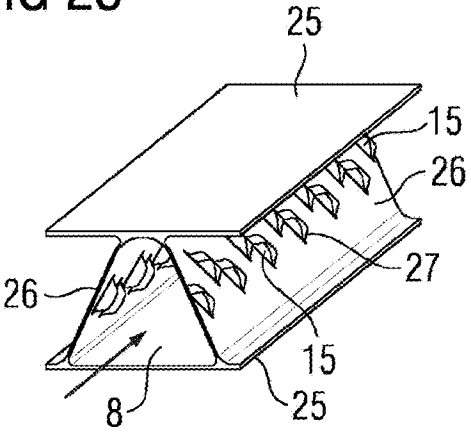
FIG. 23 shows a perspective view of a second variant of a flow duct designed in accordance with a fourth approach according to the invention, which can be a flow duct of a heat exchanger of the heat pump shown in FIG. 1.
Figure 24:
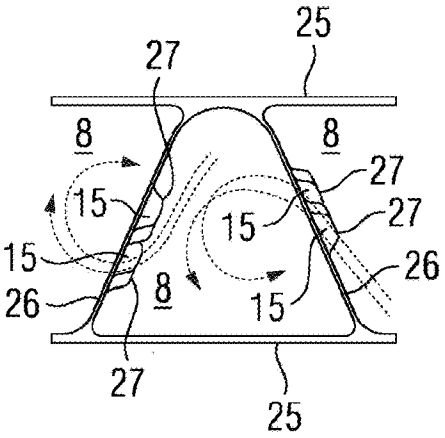
FIG. 24 shows a front view of the flow duct illustrated in FIG. 23, which shows the deflection of a fluid passed through the flow duct.
Figure 25:
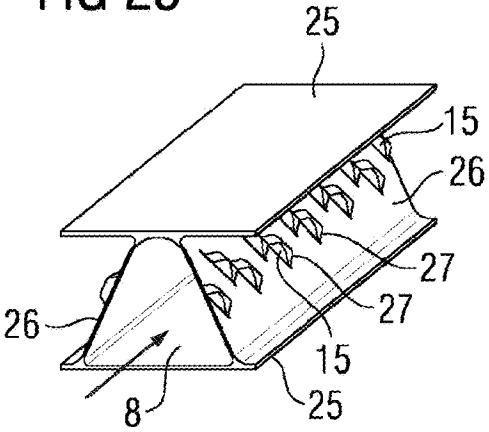
FIG. 25 shows a perspective view of a third variant of a flow duct designed in accordance with a fourth approach according to the invention, which can be a flow duct of a heat exchanger of the heat pump shown in FIG. 1.
Figure 26:
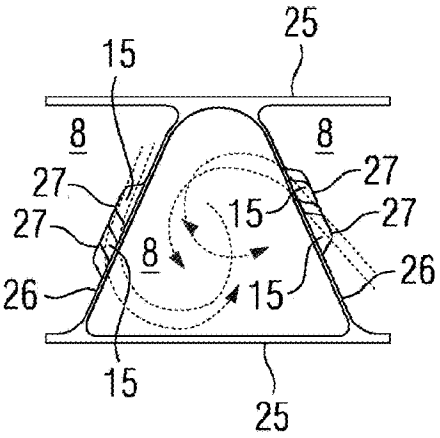
FIG. 26 shows a front view of the flow duct illustrated in FIG. 25, which shows the deflection of a fluid passed through the flow duct.

FIGS. 21 to 26 show a third approach according to the invention for increasing the intensity of heat transfer in the case of a finned plate heat exchanger. FIGS. 21, 23 and 25 show three variants of flow ducts with largely identical geometry, which are delimited by two parallel plates 25 and obliquely positioned fins 26 and each have a trapezoidal cross section. In the first variant, illustrated in FIG. 21, a fin 26 of a flow duct 8 is in each case provided with fluid passage openings 15, through which the fluid introduced into a flow duct 8 is passed into an adjacent flow duct 8 while being subjected to a swirl, see FIG. 22. The fluid passage openings 15 are each provided on the side from which the fluid is introduced into a flow duct 8 with a shield 27 that is of open design on the inflow side and, in the present case, is produced by slotting and forming the sheet forming the fin 26. In the second variant, illustrated in FIG. 23, both fins 26 of a flow duct 8 are provided with corresponding fluid passage openings 15, wherein the shields 27 are selected in such a way that the fluid introduced from a flow duct 8 into the adjacent flow duct 8 is then again passed on into the next flow duct 8, see FIG. 24. In the third variant, illustrated in FIG. 25, fluid passage openings are provided on both fins 26 of a flow duct 8, wherein the shields 27 are selected in such a way that the fluid is introduced from two flow ducts 8 into a third flow duct 8 arranged between them, see FIG. 26.

In the context of a fourth test, a total fluid mass flow was passed through the flow ducts shown in FIGS. 21, 23 and 25 under the same conditions as those in the first test. Here too, the simple tubular conduit was used as a reference, index 0.

Figure 27:
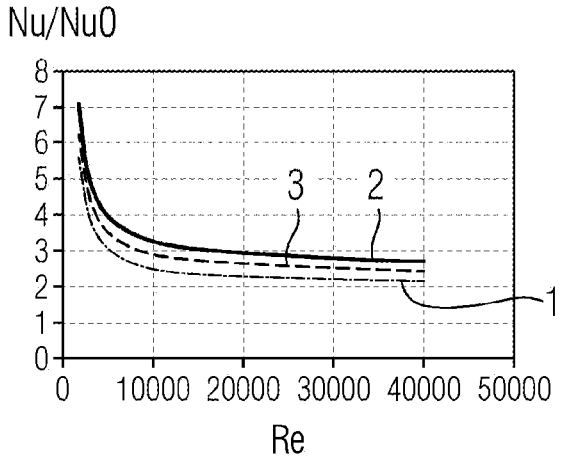
FIG. 27 shows a graph which indicates the improvement in the intensity of heat transfer of the variants illustrated in FIGS. 21, 23 and 25 relative to the reference flow duct as a function of the Reynolds number.
Figure 28:
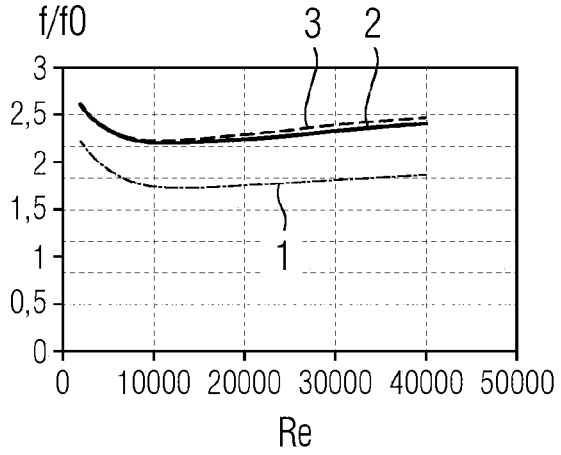
FIG. 28 shows a graph which indicates the increase in the hydraulic frictional loss in the variants illustrated in FIGS. 21, 23 and 25 relative to the reference flow duct as a function of the Reynolds number.
Figure 29:
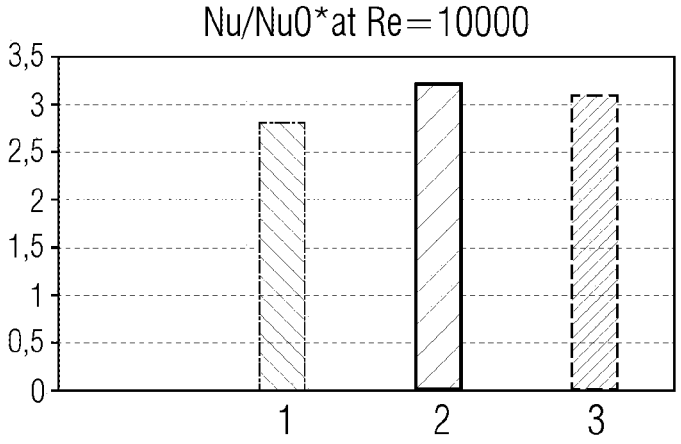
FIG. 29 shows a diagram which indicates the improvement in the intensity of heat transfer of the variants illustrated in FIGS. 21, 23 and 25 relative to the reference flow duct at a Reynolds number of 10,000.

FIGS. 27 to 29 show extracts of the results achieved in the context of the studies, wherein the numbers "1", "2" and "3" here once again represent the different variants.

The geometries of variants 1 to 3 allow an increase in the intensity of heat transfer in the flow duct 8 relative to the geometry 0 (reference) by 2.5 to 7 times, see FIGS. 27 and 29, depending on the Reynolds number, with a simultaneous rise in the hydraulic losses by 1.8 to 2.5 times, see FIG. 28. Here, the best results were achieved with the geometry of the second variant.

Figure 30:
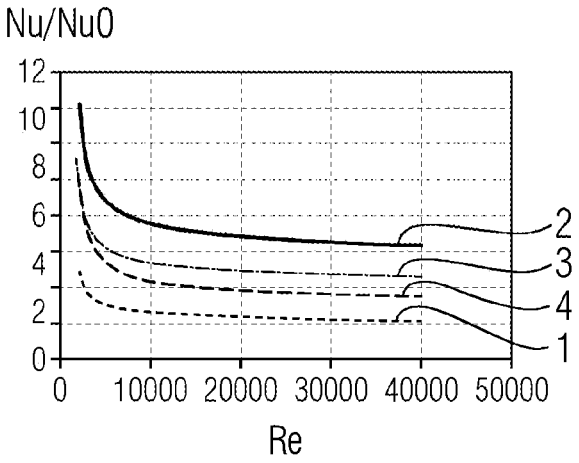
FIG. 30 shows a graph which indicates the improvement in the intensity of heat transfer of the flow ducts configured in accordance with the four approaches according to the invention relative to the reference flow duct as a function of the Reynolds number.
Figure 31:
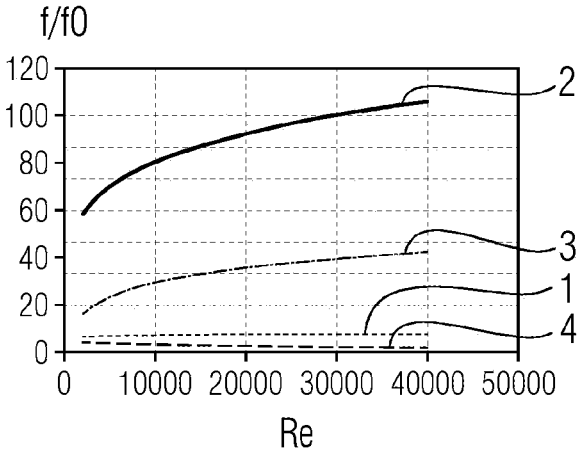
FIG. 31 shows a graph which indicates the increase in the hydraulic frictional loss in the flow ducts configured in accordance with the four approaches according to the invention relative to the reference flow duct as a function of the Reynolds number.
Figure 32:
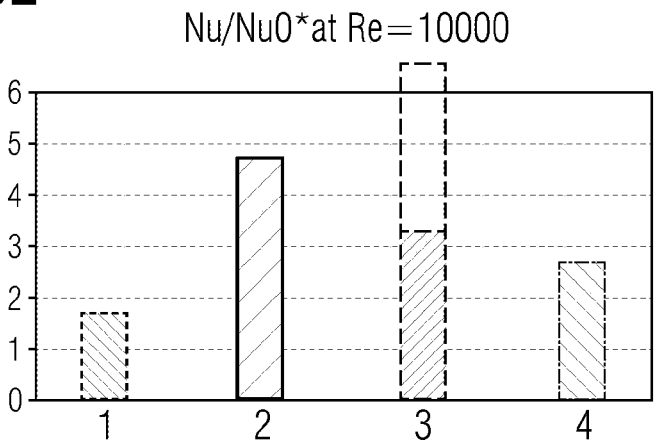
FIG. 32 shows a diagram which indicates the improvement in the intensity of heat transfer of the flow ducts configured in accordance with the four approaches according to the invention relative to the reference flow duct at a Reynolds number of 10,000.
Figure 33:
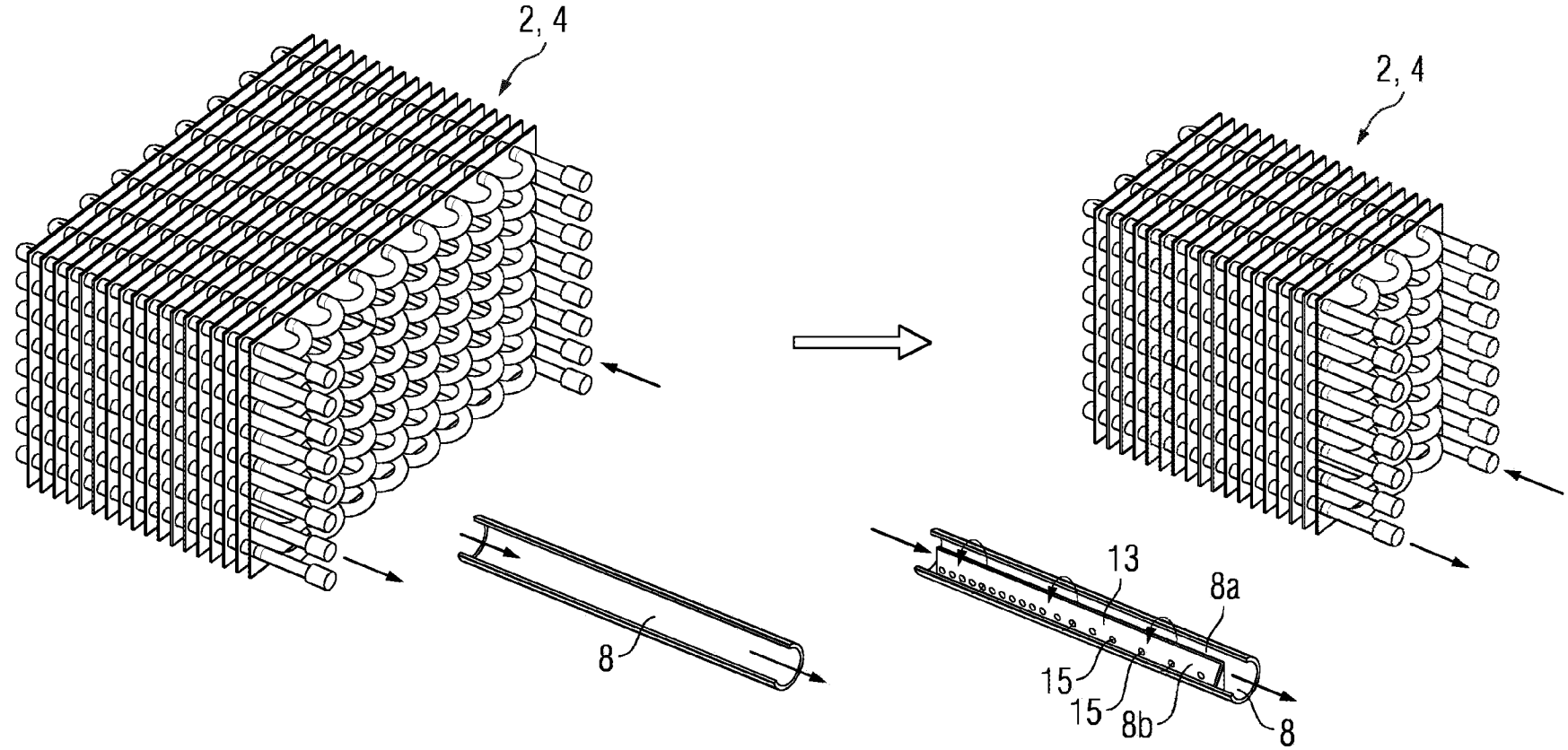
FIG. 33 shows a perspective illustration which shows by way of example a conventional heat exchanger and a heat exchanger modified in accordance with the invention.

FIGS. 30 to 32 contrast approaches 1 to 4, which are represented by the numbers "1" to "4". In summary, it can be stated that the second approach is very promising since, in the case of this approach, the greatest rise in the intensity of heat transfer is to be observed. One significant advantage of this second approach, and of the first and fourth approaches, is that it can be implemented with relatively few problems in existing heat exchanger designs, and may even be suitable for retrofitting. By way of example, FIG. 33 shows, on the left, a conventional heat exchanger 2, 4, the flow ducts 8 of which are formed by simple smooth tubular conduits of round cross section, and, on the right, a heat exchanger 2, 4 modified in accordance with the second approach, in which the overall volume is significantly reduced while achieving a comparable intensity of heat transfer.

FIG. 32 contrasts the intensities of heat transfer of the three approaches at a Reynolds number of 10,000. Admittedly, the increase in the intensity of heat transfer is less in the case of the third approach than in the case of the second approach. Nevertheless, the greatest potential for optimization is seen in the third approach. However, the third approach cannot be implemented on existing heat exchangers. On the contrary, the technical implementation of the third approach requires the construction of a novel heat exchanger 2, 4.

Although the invention has been illustrated and described in detail by way of the exemplary embodiments illustrated in the figures, the invention is not restricted by the disclosed examples and other variations may be derived therefrom by a person skilled in the art without departing from the protective scope, defined by the appended claims, of the invention. In particular, it should be noted that the heat exchangers according to the invention can be used to advantage not only with heat pumps but also in other technical fields.

The invention claimed is:

1. A heat exchanger, comprising:

at least one elongate flow duct through which a fluid is passed during operation in a main flow direction corresponding to a longitudinal extent of the flow duct, wherein the at least one elongate flow duct has internal components and/or design features which give the fluid flowing in the main flow direction a swirl in a circumferential direction of the flow duct, wherein the at least one elongate flow duct is designed as a tubular conduit, wherein the at least one elongate flow duct is divided, at least in some region or regions, into three subducts extending parallel to one another in the main flow direction, between which there extend respective partition walls, wherein a first subduct of the three subducts is provided downstream, and a second subduct and a third subduct of the three subducts are each provided upstream, with a baffle plate extending transversely to the main flow direction, and wherein the respective partition walls are provided with fluid passage openings through which the fluid introduced into the first subduct is passed into the second subduct and into the third subduct while being subjected to a swirl, wherein the first subduct has a rectangular or square cross section, and wherein the second and third subducts each have a semicircular cross section.

2. The heat exchanger as claimed in claim 1, wherein the baffle plate of the first subduct is provided with at least one through hole or with at least one through slot.

3. The heat exchanger as claimed in claim 1, wherein the fluid passage openings are arranged spaced apart from one another in the main flow direction, and/or wherein a distance between adjacent fluid passage openings increases progressively downstream.

4. A heat pump, comprising:

at least one heat exchanger as claimed in claim 1.

5. The heat exchanger as claimed in claim 1, wherein the heat exchanger comprises a tubular heat exchanger, a tube bundle heat exchanger, a finned tube heat exchanger, or a plate heat exchanger.

6. The heat exchanger as claimed in claim 2, wherein the baffle plate comprises the at least one through slot; and wherein the at least one through slot comprises two through slots.

7. The heat exchanger as claimed in claim 1, wherein the fluid passage openings are configured to cooperate with the respective semicircular cross sections to generate a second subduct swirl and a third subduct swirl; and wherein a circumferential direction of the second subduct swirl is the same as a circumferential direction of the third subduct swirl.

8. The heat exchanger as claimed in claim 7, wherein a first partition wall of the respective partition walls comprises first fluid passages and extends between the first subduct and the second subduct;

wherein a second partition wall of the respective partition walls comprises second fluid passages and extends between the first subduct and the third subduct;

wherein the first fluid passages are configured to direct fluid into a top of the semicircular cross section of the second subduct; and wherein the second fluid passages are configured to direct fluid into a bottom of the semicircular cross section of the third subduct.

* * * * *